US005427245A

United States Patent [19]

Roussel

[11] Patent Number: 5,427,245

[45] Date of Patent: Jun. 27, 1995

[54] OPENING DEVICE FOR A BAG MADE FROM FLEXIBLE MATERIAL AND PACKAGING COMPRESSIBLE PRODUCTS

[75] Inventor: Jean Roussel, Teteghem, France

[73] Assignee: Peaudouce, Linselles, France

[21] Appl. No.: 129,176

[22] PCT Filed: Apr. 8, 1992

[86] PCT No.: PCT/FR92/00308

§ 371 Date: Nov. 30, 1993

§ 102(e) Date: Nov. 30, 1993

[87] PCT Pub. No.: WO92/18396

PCT Pub. Date: Oct. 29, 1992

[30] Foreign Application Priority Data

Apr. 11, 1991 [FR] France ..... 91 04408

[51] Int. Cl.[6] ..... B65D 65/28; B65D 33/06

[52] U.S. Cl. ..... 206/494; 383/8; 383/10; 383/66; 383/203; 383/207

[58] Field of Search ..... 206/494; 383/207-209, 383/203, 200, 8, 10, 21, 66

[56] References Cited

U.S. PATENT DOCUMENTS 4,867,575 9/1989 Wood ..... 383/10 X
4,934,535 6/1990 Muckenfuhs et al. ..... 206/494
4,966,286 10/1990 Muckenfuhs et al. ..... 206/494 X
4,982,845 1/1991 Prascak et al. .
5,048,687 9/1991 Suzuki et al. ..... 383/66 X
5,054,619 10/1991 Muckenfuhs ..... 206/494 X

FOREIGN PATENT DOCUMENTS 0349050 1/1990 European Pat. Off. .
0406928 1/1991 European Pat. Off. .

*Primary Examiner*—Bryon P. Gehman
*Attorney, Agent, or Firm*—Burns, Doane, Swecker & Mathis

[57] ABSTRACT

The bag (1) for packaging compressible products arranged vertically in the form of at least one horizontal pile, substantially parallelepipedal in shape, comprising two front walls (5, 6), two side walls (3, 4), one bottom wall (7) and one top wall (8), is provided with an opening device consisting of a line of weakness forming a discontinuous contour, comprising two first vertical precut lines (13) made in each of the front walls (5, 6) and being extended by two second precut lines (15) made essentially in the part forming the base (10) of the attached handle (9), and a third precut line (14) made in the top wall (8).

9 Claims, 3 Drawing Sheets

OPENING DEVICE FOR A BAG MADE FROM FLEXIBLE MATERIAL AND PACKAGING COMPRESSIBLE PRODUCTS

The present invention relates to an opening device for a bag made from flexible material for packaging compressible products, for example hygiene products such as nappy-pants, the said bag being formed from a flexible wrapping which surrounds the products and keeps them compressed, and having a substantially parallelepipedal shape after having been filled, comprising two front walls, two side walls, one bottom wall and one top wall, and an attached handle fixed by a weld zone to the periphery of the upper part of the wrapping.

The opening device in a bag of this type, known from European Patent Application EPA-349050, is defined by the perforation lines made in one wall of the bag which is perpendicular to the direction of compression of the compressed products, in other words in a side wall. In order to prevent the compressed products from escaping from the bag when it is opened, it is provided for the opening defined by the perforation lines to have a width which is less than the width of the products, and preferably a width which increases towards the bottom.

Moreover, European Patent Application EP-A-391460 discloses a packaging bag of the same type, provided with an opening device comprising a continuous line of weakness arranged partly in one of the walls under tension from the pile of compressed products (in particular the side wall), and partly in an unstressed adjacent wall (the top wall), terminating in a pull-off tongue, so as to define a detachable opening zone covering up to 75% of the surface of the articles.

In use, however, it turns out that these packagings are not really satisfactory, in particular in the case where the products contained in the packaging are highly compressed, for example from 30 to 50% by volume as is desirable in the case of hygiene articles such as nappy-pants in order to reduce the storage and transport volume and to save on the raw materials for the packaging. Indeed, when the first products are removed, the side wall is opened or torn almost completely, which results, on the one hand, in the undesired issuing forth of products, and, on the other hand, in its being impossible to close the opening of the bag in order to protect the remaining products from contamination, in particular by dust, which is important for hygiene products.

Furthermore, the presence on packaging bags of this type of an attached handle, made from a flexible material other than that of the bag and, in particular, with a greater tear resistance, and fixed by welding to the periphery of the top wall of the bag, forms a reinforced band in this zone of the bag, which makes it more difficult to open part of the bag by pulling on precut lines passing through this zone.

The object of the present invention is to provide an opening device for a bag for packaging compressible products, enabling the packaged products to be removed easily one by one from the packaging, even when they are highly compressed, without there being any risk of the products escaping inadvertently, whilst at the same time ensuring hygienic packaging conditions for the products which are not used immediately.

Another object of the invention is to provide an opening device which enables the increased tear resistance of the wrapping of the bag to be overcome easily in the band zone of the attached handle.

The opening device according to the invention consists of a line of weakness forming a discontinuous contour, comprising two first vertical precut lines made respectively in the upper part of each of the front walls and being extended substantially in a straight line by two second precut lines made both in the upper edge of each of the front walls and in the flexible material forming the attached handle fixed to the wrapping by welding, including in the said weld zone, the said second precut lines being connected together by a third horizontal precut line made in the top wall.

According to the invention, the precut lines consist of perforations made in the flexible materials forming the wrapping of the bag and the attached handle.

According to the invention, the said first vertical precut lines constitute the greater part of the length of the precut lines made in the said front walls.

The perforations made essentially in the material forming the attached handle and in the weld zone of the latter are preferably more fragile than the perforations made in the greater part of the front walls and the top wall of the wrapping of the bag, which greater fragility is obtained by the presence of a greater number of perforations per unit length or by a different shape of the type of perforations.

Furthermore, the dimension of the precut lines made over the entire height of the front walls can be substantially between half and two-thirds of the dimension of the packaged products such as nappy-pants arranged vertically in at least one horizontal pile and compressed in the horizontal direction of the pile, in other words the direction parallel to the front walls of the bag.

The precut lines made in the flexible material forming the attached handle can advantageously be extended by pull-off means such as gripping tabs which enable the user easily to start the tearing of the said precut parts and/or of the recessed zones which weaken this region of the attached handle.

With reference to the attached diagrammatic drawings, several illustrative and non-limiting embodiments of a packaging bag equipped with an opening device according to the invention will be described below in more detail.

Figure 1:
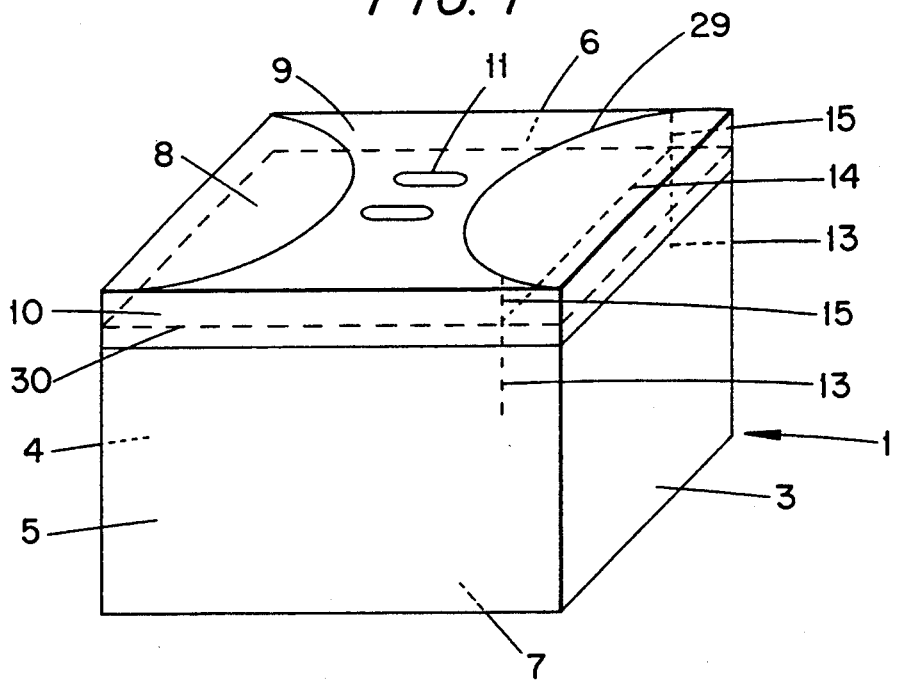
FIG. 1 is a perspective view of a preferred embodiment of an opening device for a packaging bag according to the invention.

As illustrated in FIG. 1, a bag 1 for packaging compressible products, for example hygiene products such as nappy-pants, comprises a flexible wrapping 2, preferably made from plastic sheet, which surrounds the products and keeps them compressed. In the example in FIG. 1, nappy-pants, which are not illustrated, are arranged vertically and are compressed widthwise and in the horizontal direction of the pile, in other words perpendicular to the two small side walls 3, 4 of the bag which, with its two large front walls 5, 6, its bottom wall 7 and its top wall 8, has overall an essentially parallelepipedal shape.

The bag 1 furthermore comprises an attached handle 9, a part 10 or base of which is fastened to the periphery of the bag, in the region of the joint of its top wall 8 and of its vertical walls 3, 4, 5, 6, by welding, and the other part of which is raised above the said top wall 8 and is provided with cut-outs 11 for gripping the handle.

Figure 2:
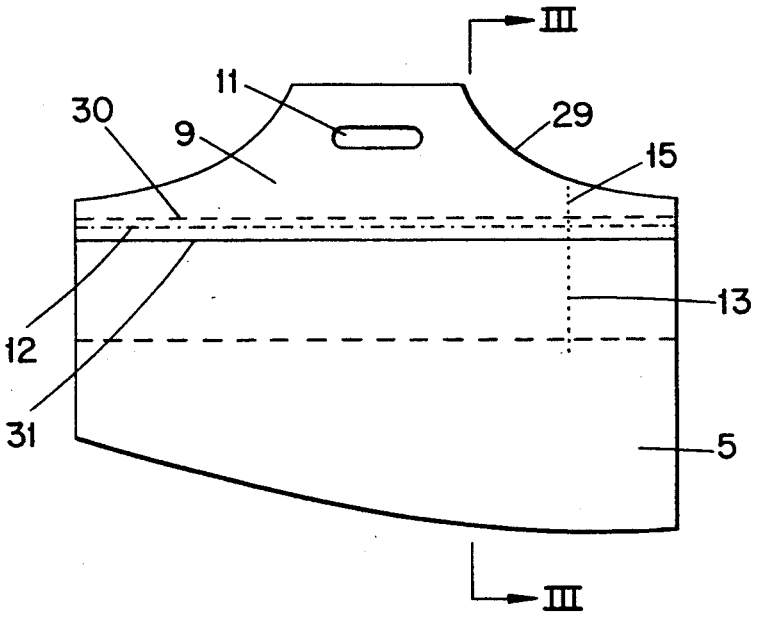
FIG. 2 is a partial front view of the said bag according to FIG. 1, not filled, on a larger scale and showing the fastening of the attached handle and the precut lines.
Figure 3:
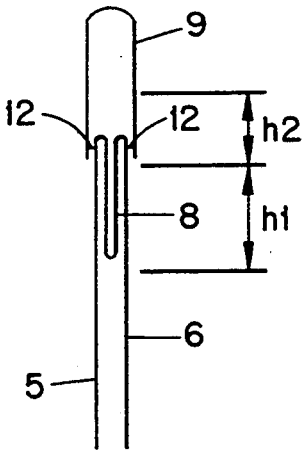
FIG. 3 is a sectional view of FIG. 2 along the lines III—III, showing the delimitation of the precut lines.
Figure 4:
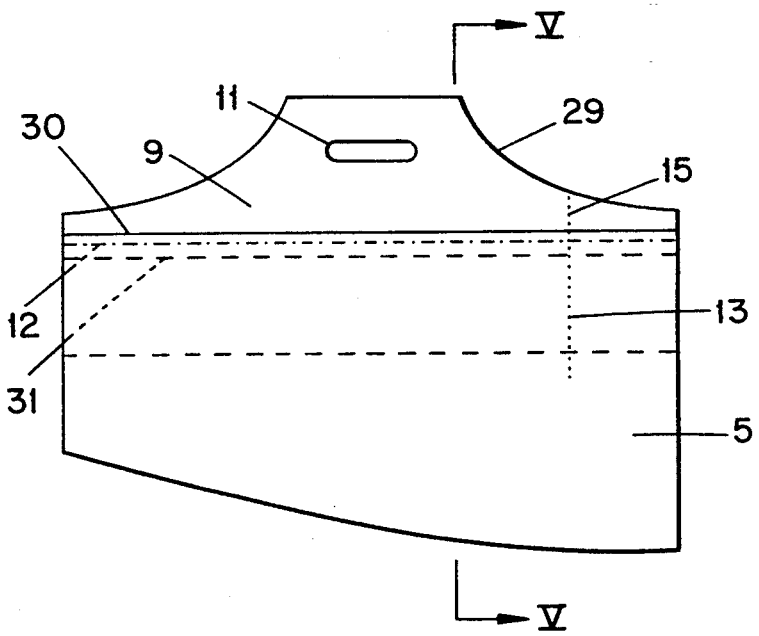
FIG. 4 is a partial front view of the bag, with an attached handle fastened according to an alternative embodiment.
Figure 5:
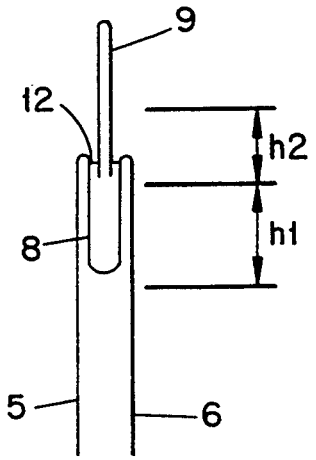
FIG. 5 is a sectional view of FIG. 4 along the lines V—V.

As shown in FIGS. 1, 2 and 3, the base of the attached handle 9 can be arranged outside the wrapping of the bag 1 and fastened to this wrapping by the weld lines or strips 12 which run all around the wrapping substantially in the region of the upper edges 30 of the vertical walls 3, 4, 5, 6. It can be seen that the lower horizontal edge 31 of the base of the said attached handle 9 protrudes and is positioned slightly beneath the edges 30. However, in another embodiment, illustrated by FIGS. 4 and 5, the base of the attached handle 9 can be welded by the lines 12 to the inside of the vertical walls, in particular on the top wall 8 which is folded like an internal bellows during the manufacture of the bag. In this case, the lower edge 31 of the base of the attached handle 9 does not overlap the upper edges of the walls 5, 6.

The bag also comprises an opening device which consists of various precut lines 13, 14, 15 which are formed on the bag when it is flat during manufacture.

As illustrated in FIGS. 2 to 5, and moreover irrespective of the embodiment of the attached handle, the two vertical precut lines 13 arranged respectively in the upper portion of each of the front walls 5, 6 of the bag are made over a height h1 with the aid of a first part of an appropriate perforating tool. During this perforation stage, the majority of the precut line 14 is also made in the top wall 8, folded like an internal bellows; moreover, the two precut lines 15 arranged as extensions of the lines 13 are made over a height h2 with the aid of a second part of the said perforating tool, mainly in the flexible material forming the attached handle 9 as far as its end edge 29 but also over a small distance in the front walls 5, 6 of the bag and in the top wall. These precut lines 13 and 15, connected together by the lines 14, form a line of weakness for the packaging bag, having a discontinuous contour.

Taking into account the differences in tear resistance of the flexible materials which are employed respectively for manufacturing the wrapping of the bag, and the attached handle, the number of perforations per unit length is higher for the height h2, in other words for the precut lines 15, than for the height h1, in other words for the precut lines 13 and 14 in the walls of the bag.

The precut lines in the region of the attached handle and in the region of its weld to the bag have thus been made fragile preferentially. This result could have been obtained by using different types of perforation for each perforation line 13 and 15.

The vertical precut lines 13 can preferably be arranged at a distance, at least equal to the thickness of a product, from the edge of one of the side walls, thus making the first nappy-pants easier to remove.

Figure 7:
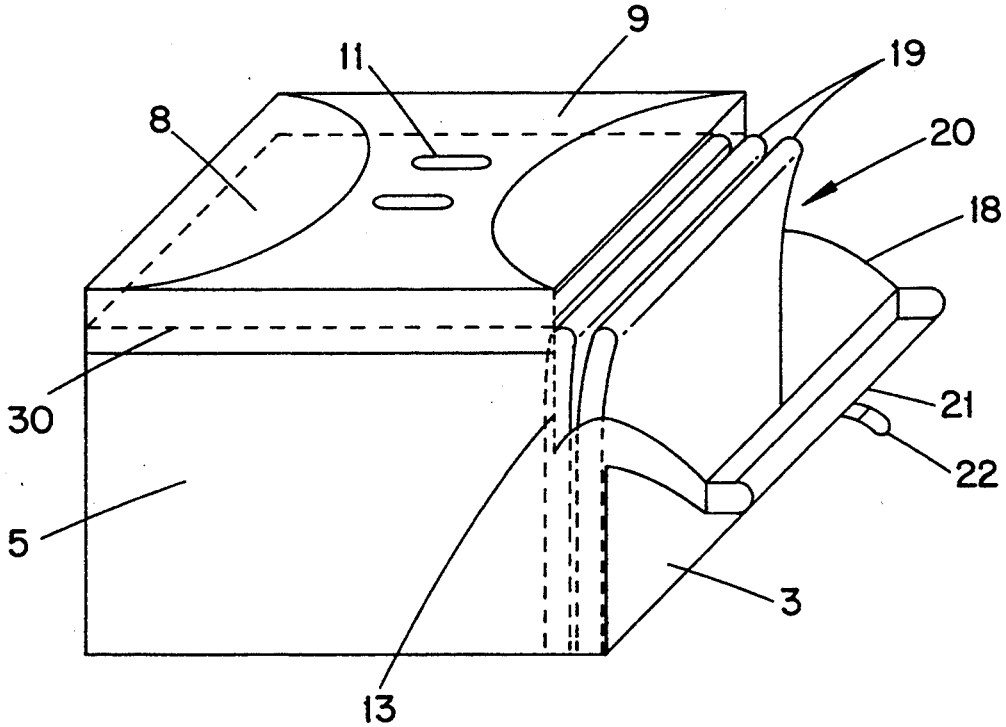
FIG. 7 is a perspective view of the packaging bag according to the invention after having been opened.

Furthermore, the said precut lines 13 can extend over a height which lies approximately between half and $\frac{2}{3}$ of the longitudinal dimension of the nappy-pants arranged vertically in the bag, as illustrated in FIG. 7, in at least one horizontal pile and compressed by at least 30% in the horizontal direction of the pile.

Figure 6:
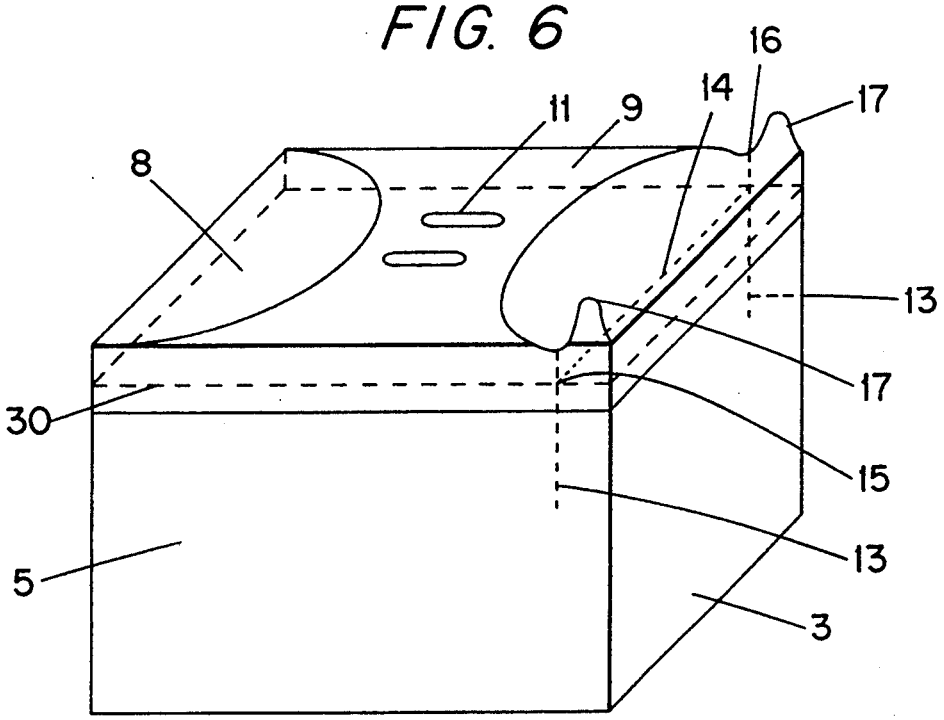
FIG. 6 is a perspective view of a second embodiment of the opening device for a packaging bag.

As shown in FIG. 6, which illustrates an alternative embodiment, the precut lines 15 made in the flexible material forming the attached handle 9 end in a recessed zone 16, completed by a gripping tab 17 which makes it easier for the user to take hold of the edges of this part of the handle; indeed, in order to open the bag, the user respectively takes hold of each tab 17 between the thumb and index finger of each hand and starts the tearing of the precut portion simply by exerting an even pull on each tab 17 in a direction away from the front wall of the bag.

FIG. 7 illustrates the final state of the packaging bag for nappy-pants after the part 18 of the bag, defined by the perforation lines 13 to 15, has been pulled off.

It can be seen that the first pair of nappy-pants 19 is then accessible through the pocket-shaped opening 20 thus formed, and can be withdrawn without difficulty, as can the following nappy-pants one by one. The nappy-pants are, however, held perfectly in position in the bag and the bag can be closed at any moment by folding the partially detached portion 18 back against the edge of the top wall 8, and by fastening it to the latter, for example by having provided the edge 21 of the said part 18 with a fastening element such as a repositionable self-adhesive fastener 22 which thus ensures improved protection against risks of dirtying or stains.

It should be noted that the embodiments described above and illustrated in the attached drawings are merely illustrative and non-limiting examples, and that numerous modifications and alternatives are possible within the scope of the invention.

The packaged products, which can be products other than nappy-pants, can be contained in the form of a plurality of horizontal piles juxtaposed or superposed in the bag or packet. Furthermore, the rectangular products arranged in parallel vertical planes, instead of being placed upright as in FIG. 7 with their large edges vertical, could also be placed lying down, with their large edges horizontal.

I claim:

1. Opening device for a bag made from flexible material for packaging compressible products, the said bag being formed from a flexible wrapping which surrounds the products and keeps them compressed, and having a substantially parallelepipedal shape after having been filled, comprising two front walls, two side walls, one bottom wall and one top wall, and an attached handle fixed by a weld zone to the periphery of the upper part of the wrapping, said opening device comprising a line of weakness forming a discontinuous contour, having two first vertical precut lines made respectively in the upper part of each of the front walls and being extended substantially in a straight line by two second vertical precut lines made both on the upper edge of each of the front walls and in the flexible material forming the attached handle fastened to the wrapping by welding, including in the said weld zone, the said second precut lines being connected together by a third horizontal precut line made in the top wall.

2. Device according to claim 1, wherein the said precut lines consist of perforations made in the flexible materials forming the wrapping of the bag and the attached handle.

3. Device according to claim 2, wherein the perforations made in the material forming the attached handle and in the weld zone are more fragile than the perforations made in the greater part of the front walls and the top wall of the wrapping of the bag, which greater fragility is obtained by the presence of a greater number of perforations per unit length or by a different shape of the type of perforations.

4. Device according to claim 1, wherein the said first vertical precut lines constitute the greater part of the length of the precut lines made in the said front walls.

5. Device according to claim 1, wherein the dimension of the vertical precut lines made over the entire height of the front walls can be substantially between half and two-thirds of the dimension of the packaged products arranged vertically in at least one horizontal pile and compressed in the horizontal direction of the at least one pile, parallel to the front walls of the bag.

6. Device according to claim 1, wherein the vertical precut lines are arranged at a distance, at least equal to the thickness of a product to be packaged, from the edge of one of the side walls.

7. Device according to claim 1, wherein the second vertical precut lines made in the flexible material forming the attached handle are extended by pull-off means for starting the tearing of the part of the bag which is delimited by the precut lines by pulling on the pull-off means.

8. Device according to claim 7, wherein the second vertical precut lines comprise, at ends adjacent to the pull-off means, recessed zones which weaken the part of the bag which is delimited by the precut lines adjacent to the attached handle.

9. Device according to claim 1, wherein the portion of the walls of the bag which is partially detached from the remainder of the wrapping along the precut lines when the bag is opened forms a pocket-shaped opening which can be folded back and temporarily fastened to the top wall via its edge which is provided with a repositionable adhesive fastener.

* * * * *